US011783965B2

(12) United States Patent
Peng et al.

(10) Patent No.: US 11,783,965 B2
(45) Date of Patent: Oct. 10, 2023

(54) FLAT CABLE ASSEMBLY

(71) Applicant: LUXSHARE TECHNOLOGIES INTERNATIONAL, INC., Milpitas, CA (US)

(72) Inventors: ZhongChao Peng, Dongguan (CN); JinChang Dai, Dongguan (CN); BenTao Hu, Dongguan (CN); HuanZhong Yan, Dongguan (CN); Andrew John Nowak, Milpitas, CA (US); Charles Lloyd Grant, Milpitas, CA (US)

(73) Assignee: LUXSHARE TECHNOLOGIES INTERNATIONAL, INC., Milpitas, CA (US)

( * ) Notice: Subject to any disclaimer, the term of this patent is extended or adjusted under 35 U.S.C. 154(b) by 0 days.

(21) Appl. No.: 18/110,538

(22) Filed: Feb. 16, 2023

(65) Prior Publication Data

US 2023/0197313 A1 Jun. 22, 2023

Related U.S. Application Data

(63) Continuation of application No. 17/476,047, filed on Sep. 15, 2021, now Pat. No. 11,621,103.

(30) Foreign Application Priority Data

Oct. 9, 2020 (CN) ..... 202022229546.8

(51) Int. Cl.
*H01B 7/08* (2006.01)

(52) U.S. Cl.
CPC ..... *H01B 7/0807* (2013.01); *H01B 7/0823* (2013.01); *H01B 7/0861* (2013.01)

(58) Field of Classification Search
CPC .. H01B 7/0861; H01B 7/0838; H01B 7/0823; H01B 7/0807; H01B 11/1091
See application file for complete search history.

(56) References Cited

U.S. PATENT DOCUMENTS 4,185,162 A 1/1980 Bogese, II
6,677,518 B2 * 1/2004 Hirakawa ..... H01B 11/1091 174/36

(Continued)

FOREIGN PATENT DOCUMENTS

CN 208014407 U 10/2018

*Primary Examiner* — William H. Mayo, III
*Assistant Examiner* — Rhadames Alonzo Miller
(74) *Attorney, Agent, or Firm* — Birch, Stewart, Kolasch & Birch, LLP

(57) ABSTRACT

The application discloses a flat cable assembly, which includes a plurality of cables arranged in a row and an insulating film. The cables have a center line and include connecting portions, a signal wire and a grounding wire respectively. The connection portions are located on one side of the center line. The insulating film is disposed on the connecting portion of any one of the cables and located on one side of the central line. The cables are exposed from the insulating film. The insulating film is disposed on a single side of the cables, whereby the cables are exposed from the insulating film. The flat cable assembly is easily manufactured and the amount of the cables therein can be varied according to real practice condition. The grounding wire is integrated to each cable, whereby the flat cable assembly has an excellent anti-EMI effect and performance in signal transmission.

17 Claims, 7 Drawing Sheets

(56) References Cited

U.S. PATENT DOCUMENTS

| | | | | |
|---|---|---|---|---|
| 10,381,136 | B2 | 8/2019 | Grant | |
| 10,964,448 | B1 * | 3/2021 | Wright | H01B 3/421 |
| 2003/0150633 | A1 * | 8/2003 | Hirakawa | H01B 11/002 174/36 |
| 2011/0247856 | A1 * | 10/2011 | Matsuda | H01B 11/203 174/108 |
| 2012/0090873 | A1 * | 4/2012 | Gundel | H01B 11/04 174/113 R |
| 2013/0146326 | A1 * | 6/2013 | Gundel | H01B 11/1895 174/102 R |
| 2014/0182881 | A1 * | 7/2014 | Huang | H01B 11/1091 174/103 |
| 2015/0294760 | A1 | 10/2015 | Gundel | |
| 2018/0075948 | A1 * | 3/2018 | Kobayashi | H01B 7/36 |
| 2018/0102204 | A1 * | 4/2018 | Li | H01B 11/1808 |
| 2018/0158574 | A1 * | 6/2018 | Dai | H01B 11/1856 |
| 2019/0096542 | A1 * | 3/2019 | Huang | H01B 7/0838 |
| 2019/0172611 | A1 | 6/2019 | Sugiyama | |
| 2019/0198199 | A1 | 8/2019 | Gundel | |
| 2019/0318841 | A1 * | 10/2019 | Hornung | H01B 11/1016 |
| 2020/0185124 | A1 * | 6/2020 | Yang | H01B 7/0861 |

* cited by examiner

FLAT CABLE ASSEMBLY

CROSS-REFERENCE TO RELATED APPLICATIONS

This application is a Continuation Applications of U.S. patent application Ser. No. 17/476,047, filed on Sep. 15, 2021, which claims the priority benefit of China Patent Application Serial Number 202022229546.8 filed on Oct. 9, 2020. These and all other referenced extrinsic materials are incorporated herein by reference in their entirety.

BACKGROUND

Technical Field

This present invention generally relates to the field of cable and, more particularly, to a flat cable assembly.

Related Art

A flat cable assembly includes several signal cables, two grounding wires and two insulating layers. The signal cables are arranged in a row, and the grounding wires are disposed on two lateral sides of the row of the signal cables. Such a flat cable assembly must be manufactured by a more complicated process as several positioning steps have to be performed during the process. In addition, the signal wire of the flat cable assembly cannot be regulated according to real practice conditions.

SUMMARY

The embodiments of the present invention provides a flat cable assembly to solve the problem of the complicated manufacturing process and the problem of non-regulation of the inner structure for various practice condition.

In one embodiment, the flat cable assembly includes a plurality of cables and an insulating film. The cables are arranged in a row and having a central line, wherein each of the cables has a connecting portion, a signal wire and a grounding wire, the connecting portion is located on one side of the central line. The insulating film is disposed on the connecting portion of any one of the cables, the insulating film is located on one side of the central line, and the cables are exposed from the insulating film.

As for the flat cable assembly of the present disclosure, the grounding wires are integrated to each cable respectively and the insulating film is disposed on the single side of the cables, whereby the cables are exposed from the insulating film. Therefore, the flat cable assembly is easily manufactured and cane be regulated or rearranged according to the real practices. The flat cables assembly has excellent anti-EMI effect and excellent signal transmission performance.

It should be understood, however, that this summary may not contain all aspects and embodiments of the present invention, that this summary is not meant to be limiting or restrictive in any manner, and that the invention as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

The present invention will now be described more fully hereinafter with reference to the accompanying drawings, in which exemplary embodiments of the invention are shown. This present invention may, however, be embodied in many different forms and should not be construed as limited to the embodiments set forth herein. Rather, these embodiments are provided so that this present invention will be thorough and complete, and will fully convey the scope of the present invention to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the invention. This description is made for the purpose of illustration of the general principles of the invention and should not be taken in a limiting sense. The scope of the invention is best determined by reference to the appended claims.

Figure 1:
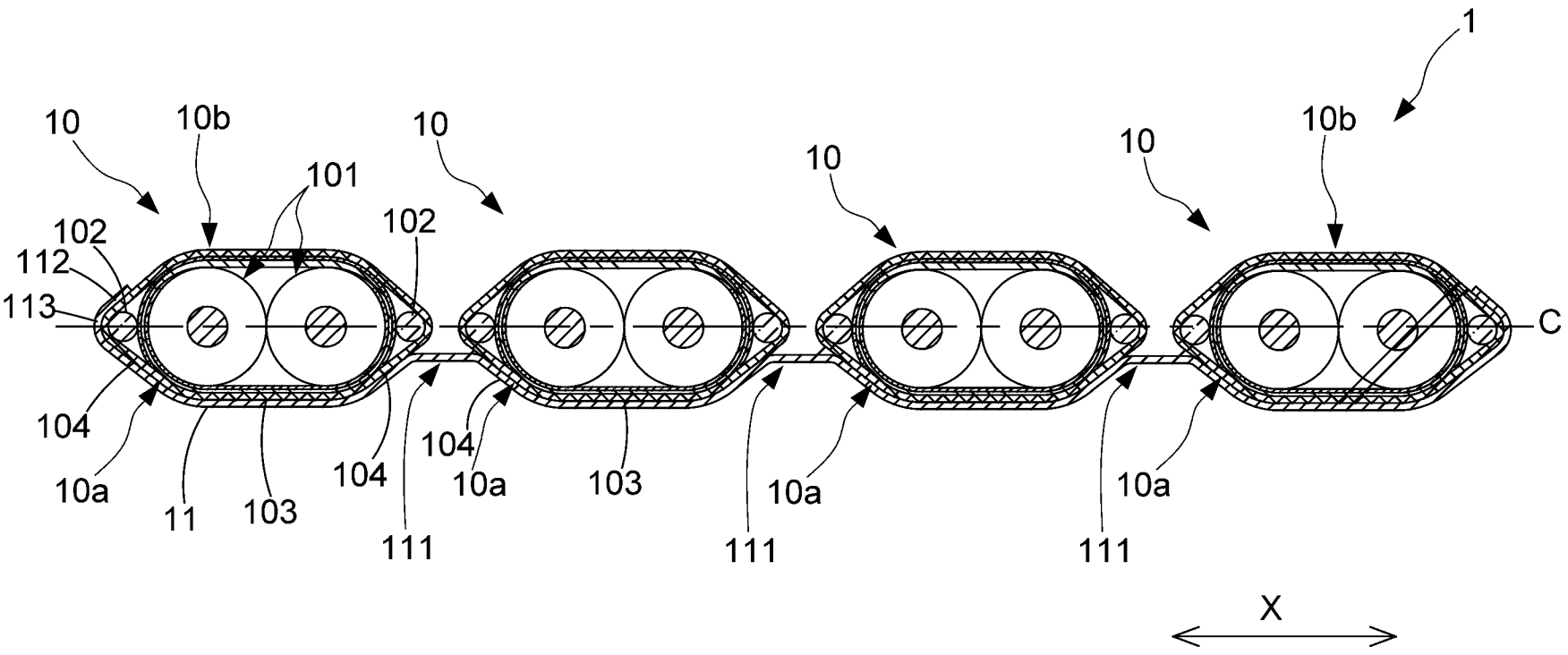
FIG. 1 is a schematic view of the first embodiment of a flat cable assembly of the present application.
Figure 2:
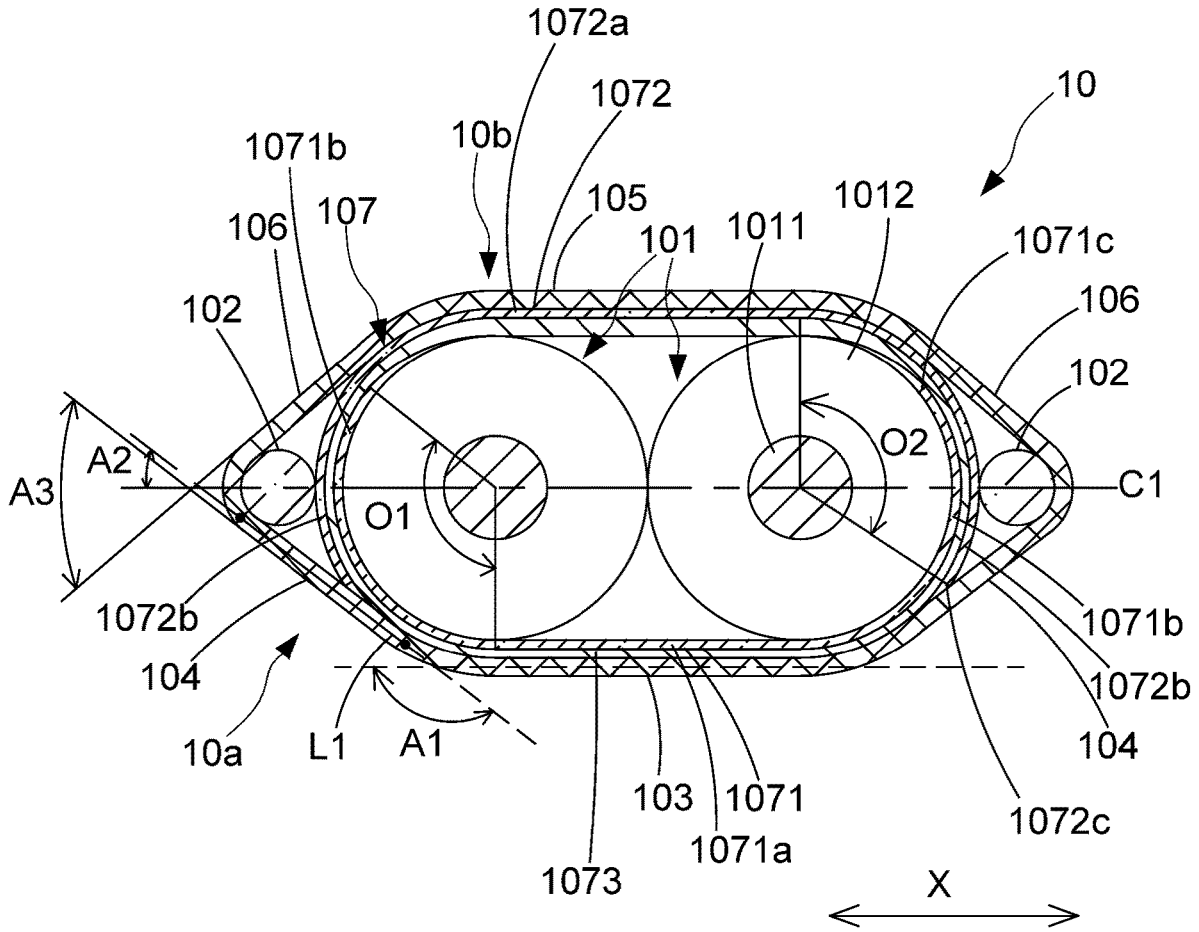
FIG. 2 is a schematic view of the first embodiment of a cable of the present application.

Referring to FIGS. 1 and 2, a flat cable assembly of the present embodiment includes a plurality of cables 10 and an insulating film 11. The cables 10 are arranged in a row along a horizontal direction X. In the present embodiment, the cables are located in the same horizontal plane. The plurality of cables 10 have a central line C parallel to the horizontal direction X. Each cable 10 has a first central line C1 parallel with the horizontal direction X. When the cables 10 are arranged in a row along the horizontal direction X, the first central line C1 of each cables 10 is aligned with the first central line C1 of the adjacent cable 10, and the first central lines C1 of all cables 10 are connected to form the central line C. Each of the cables 10 has a connecting portion 10*a* disposed on one side of the central line C. In the present embodiment, the connecting portions 10*a* of the cables 10 are disposed on a lower side of the central line C.

Each cable 10 includes a signal wire 101 and a grounding wire 102. An insulating film 11 is disposed on the connecting portions 10*a* of the cables 10 and located on one side of central line C to serially connect the plurality of cables 10 so as to form the flat cable assembly 1. The flat cable assembly 1 is half-opened, that is the insulating film 11 is disposed on the side of the cables 10 where the connecting portions 10*a* are disposed, and the other side of the cables 10 are exposed from the insulating film 11, whereby the manufacture process of the flat cable assembly 1 is simplified. In addition, when the amount of the cables 10 of the flat cable assembly 1 are varied, at least one cable 10 can be removed to improve the efficiency.

Specifically, the connecting portion 10*a* of each cable 10 has a first surface 103 parallel with the horizontal direction X and two second surfaces 104 symmetrically disposed on two sides of the first surface 103. The line L1 extending through two lateral sides of the second surface 104 with the shortest distance is inclined with respect to an extending line along the first surface 103 (the horizontal direction X) and has an angle A1 greater than 90 degree with respect to the extending line along the first surface 103. The line L1 extending through two lateral sides of the second surface 104 with the shortest distance has an angle A2 less than 90 degree with respect to the first central line C1 (the central line C of the plurality of cables 10). The second surface 104 of the present embodiment is a plane and coincides with the line L1 extending through two lateral sides of the second surface 104 with the shortest distance, that is the angle between the first surface 103 and the second surface 104 is greater than 90 degree.

Figure 3:
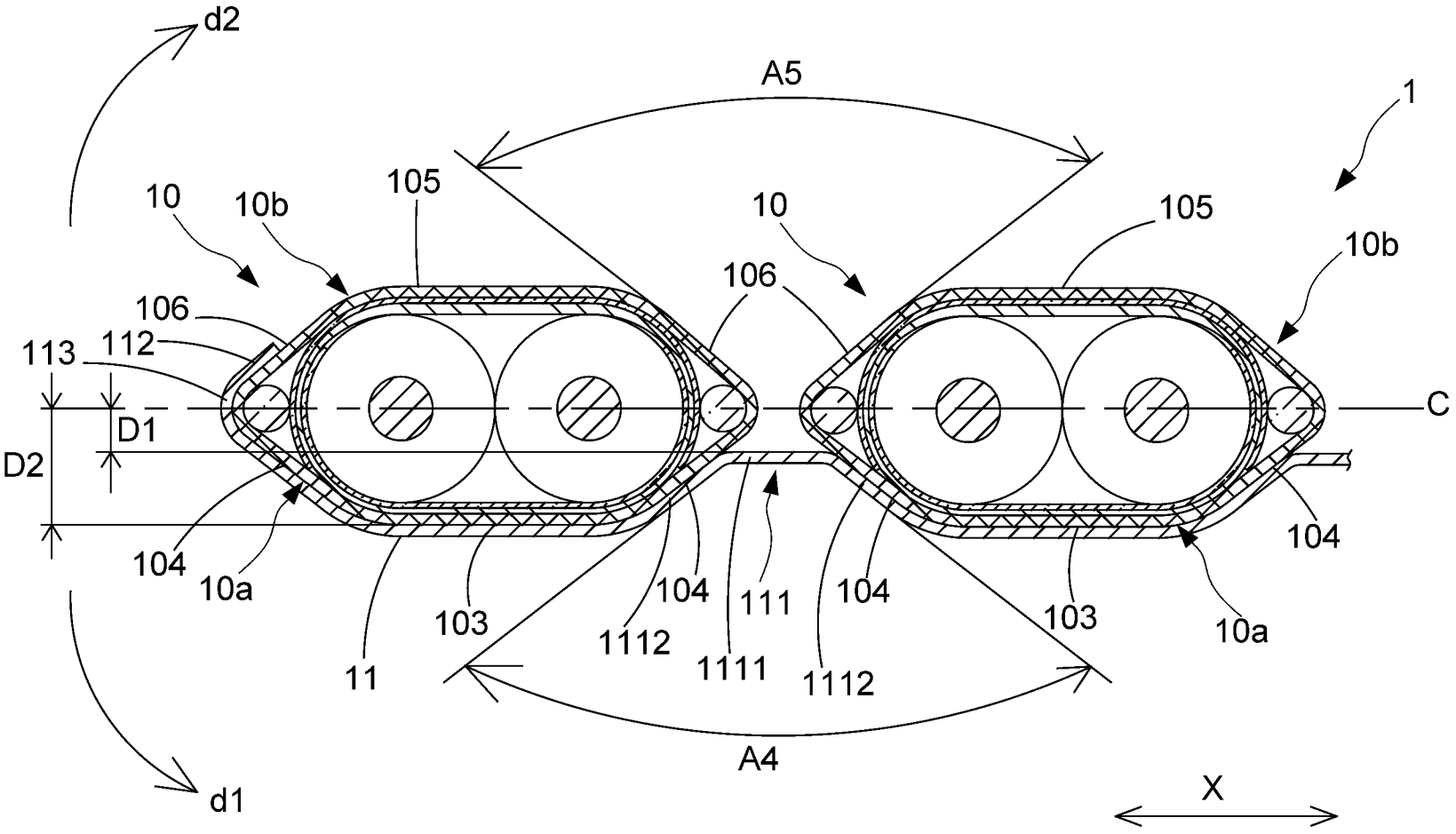
FIG. 3 is a partially schematic view of the first embodiment of a flat cable assembly of the present application.

Referring to FIG. 3, when the insulating film 11 is disposed on the connecting portion 10*a*, the insulating film 11 covers the first surface 103 and the second surfaces 104. The insulating film 11 has a plurality of connecting concave portions 111 are located between the connecting portions 10*a*. In the present embodiment, each connecting concave portion 111*a* is located between two adjacent first connecting portions 10*a* and covers the both second surfaces 104. A minimum distance D1 between a bottom of the connecting concave portions 111*a* and the central line C the cables 10 is smaller or equal to half a minimum distance D2 between the first surface 103 and the central line C of the cables 10. Even a bottom of the connecting concave portions 111*a* is located on the central line C of the cables 10, whereby the contact area of the insulating film 11 and the cables 10 is increased so as to increase the reliability and stability of the connection of the insulating film 11 and the cables 10.

In one embodiment, each cable 10 further has a fixing portion 10*b* symmetrical with the connecting portion 10*a*. The fixing portion 10*b* is located on the other side of the central line C. The fixing portion 10*b* also has a third surface 105 and two fourth surfaces 106 symmetrically located on two sides of the third surface 105. The third surface 105 and the first surface 103 are symmetrical with respect to the central line C of the cables 10 and parallel with the horizontal direction X. The both fourth surface 106 and the both second surface 104 are symmetrical with respect to the central line C of the cables 10. An angle A3 of the second surface 104 and the adjacent fourth surface 106 are smaller than 180°.

The insulating film 11 further includes extending fixing portion 112 disposed on the fourth surface 106 of the fixing portion 10*b* of the outermost cable 10, whereby the insulating film 11 extends across the central lines C of the cables 10, and both sides of the insulating film 11 are located on different sides of the central lines C. A bending portion 113 is provided on both sides of the insulating film 11 respectively, that is the bending portion 113 is located between the connecting portion 10*a* and the fixing portion 10*b*. The bending portion 113 has a bending angle less than 180°, whereby both sides of the insulating film 11 do not easily escape from the corresponding cables 10.

The cables 10 are separately arranged on the same plane, and a gap exists between the adjacent cables 10. When the insulating film 11 is disposed on the cables 10, each connecting concave portion 111 has a cutting surface 1111 connected to two adjacent connecting portions 10*a* on both sides and located between the adjacent connecting portions 10*a*. The cutting surface 1111 is parallel to the horizontal direction X. When at least one cable 10 is removed from the cables 10, a user may cut the flat cable assembly 1 along the cutting surface 1111 of the corresponding connecting concave portion 111. The connecting concave portion 111 has a cross section shaped as a trapezoid. Certainly, the cross section of the connecting concave portion 111 can be rectangular, that is the cutting surface 1111 of the connecting concave portion 111 is not parallel with the horizontal direction X.

Each connecting concave portion 111 has two opposite connecting lateral walls 1112 connected to the second surfaces 104 of the adjacent cables 10. The insulating film 11 can be flexible or rigid. In case that the insulating film 11 is flexible, the both connecting lateral walls 1112 of the connecting concave portions 111 have a first variable angle A4 therebetween. When the flat cable 1 is bent toward a first direction d1, the both connecting lateral walls 1112 of the connecting concave portions 111 move toward each other, whereby the first variable angle A4 becomes smaller, the both fourth surface 106 of the two fixing portions 10*b* of the adjacent cables 10 move away from each other, whereby the second variable angle A5 between the adjacent fourth surfaces 106 becomes larger. When the flat cable 1 is bent toward a second direction d2, the both connecting lateral walls 1112 of the connecting concave portions 111 move away from each other, whereby the first variable angle A4 becomes larger, but the both fourth surface 106 of the two fixing portions 10*b* of the adjacent cables 10 move toward each other, whereby the second variable angle A5 between the adjacent fourth surfaces 106 becomes smaller. In case that the insulating film 11 is rigid, the insulating film 11 secure the cables 10 in predetermined position and the flat cable assembly 1 cannot be bent.

Figure 4:
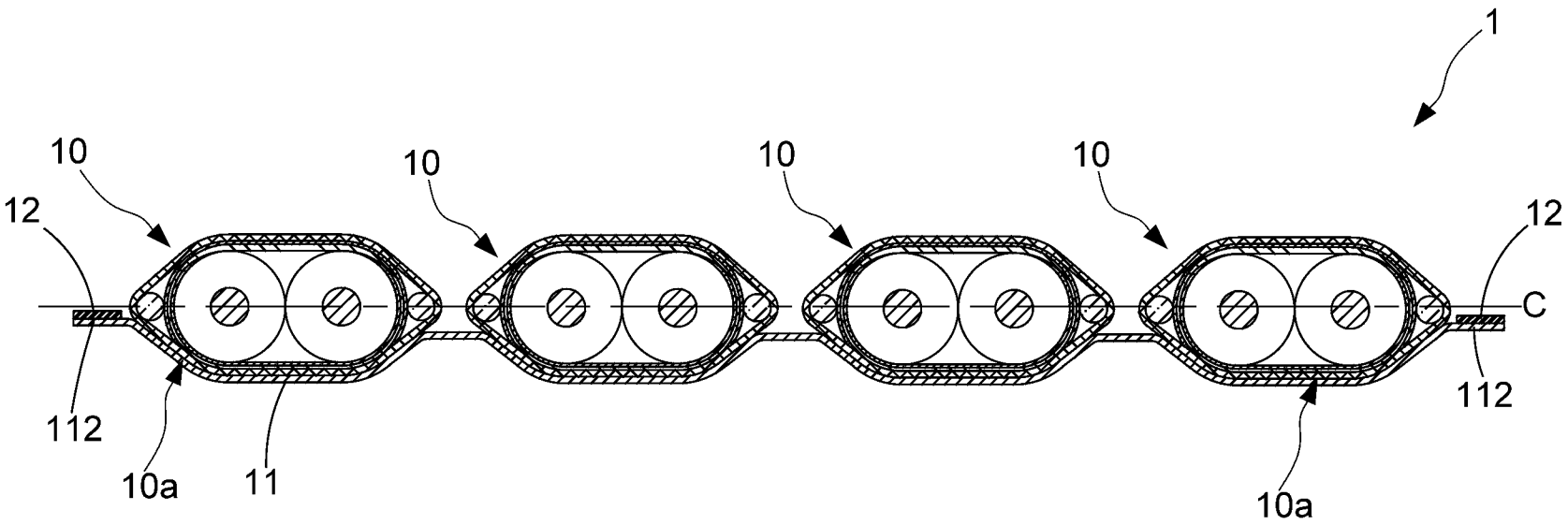
FIG. 4 is a schematic view of the second embodiment of a flat cable assembly of the present application.

Referring to FIG. 4, the second embodiment of the flat cable assembly of the present application is shown. The flat cable assembly 1 of the present embodiment differs from the flat cable assembly of the first embodiment in that the extending fixing portions 112 of the insulating film 11 are not connected to outermost the cables 10 and extend from the connecting portion 10*a* along a direction away from the cables 10. The insulating film 11 is disposed on a single side of the central line C. When the flat cable assembly 1 is connected to a device, the extending fixing portions 112 of the insulating film 11 can be connected to a surface of the device to secure the flat cable assembly 1 to the device. The flat cable assembly 1 further includes two release films 12 disposed on the extending fixing portions 112. When the extending fixing portions 112 is not used, the release films 12 protects the extending fixing portions 112 from dust or particles being attached to the extending fixing portions 112 before the extending fixing portions 112 are used. The release films 12 are removed when the extending fixing portions 112 are intended to be secured to a surface of the device.

Figure 5:
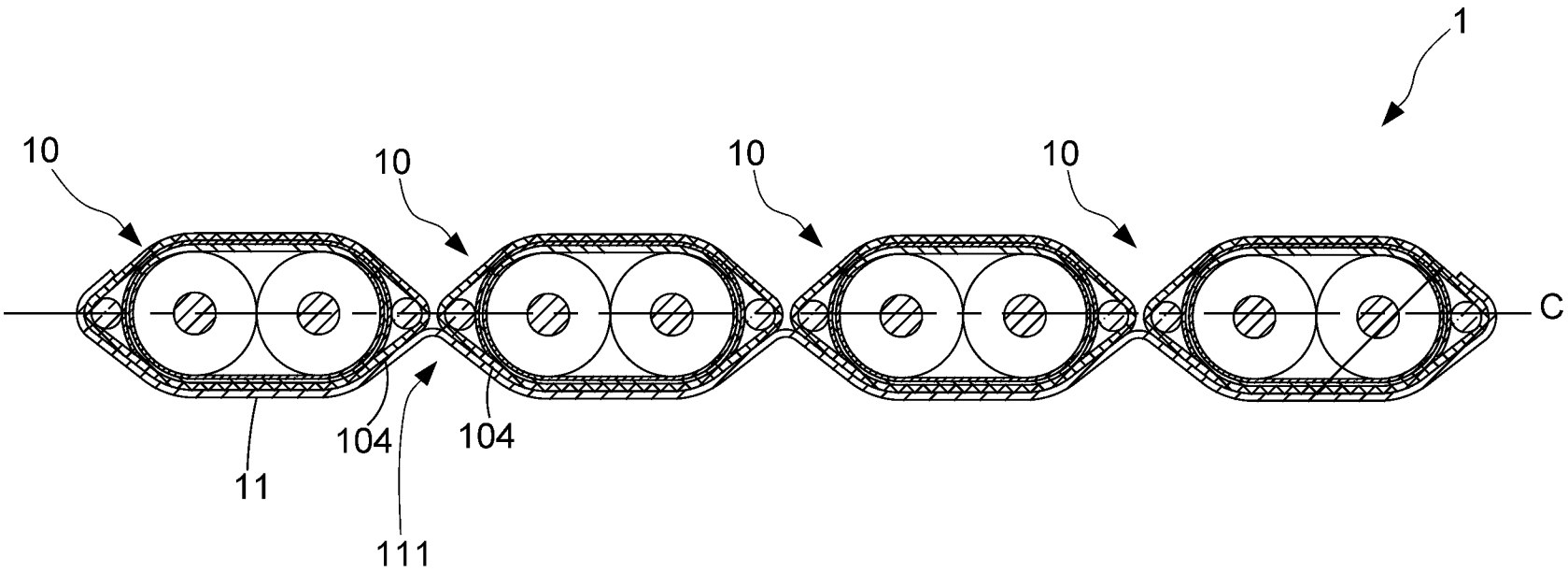
FIG. 5 is a schematic view of the third embodiment of a flat cable assembly of the present application.

Referring to FIG. 5, the third embodiment of the flat cable assembly of the present application is shown. The flat cable assembly 1 of the present embodiment differs from the flat cable assembly of the first embodiment in that the cables 10 of the present embodiment abut each other. Each connecting concave portion 111 of the insulating film 11 is disposed on the both fourth surfaces 104 of the adjacent cables 10. The connecting concave portion 111 has a cross section shaped as a triangle, whereby the flexibility of the flat cable assembly 1 is increased.

The first embodiment, the second embodiment and the third embodiment of the cable 10 have the same structure. The first embodiment of the cable 10 is described as an example. Referring to FIG. 2 again, the cable 10 further includes an electrically conductive layer 107 and an insulating enclosing layer 108. Each of the cables 10 includes two signal wires 101. The both signal wires 101 are arranged along the horizontal direction X and abut each other. The electrically conductive layer 107 encloses the signal wires 101. Each of the cables 10 includes two grounding wires 102 disposed on two sides of the electrically conductive layer 107 and contacting the electrically conductive layer 107. The insulating enclosing layer 108 encloses the grounding wires 102 and the electrically conductive layer 107 enclosing the signal wires 101. The centers of the signal wires 101 and the centers of the grounding wires 102 are arranged in a row along the horizontal direction X and located at the first central line C1 (the central line C of the cables 10).

As shown in FIG. 2, the electrically conductive layer 107 of the present embodiment includes a first conductive film 1071 and a second conductive film 1072 on an inner surface thereof. The first conductive film 1071 and the second conductive film 1072 are opposite disposed. The first conductive film 1071 and the second conductive film 1072 surround the signal wires 101, and the grounding wires 102 contact the second conductive film 1072. The first conductive film 1071 of the present embodiment includes a first covering portion 1071*a* and two first enclosing portions 1071*b* located at two sides of the first covering portion 1071*a*, and a first notch 1071*c* corresponding to the first covering portion 1071*a* is formed between the first enclosing portions 1071*b*. The second conductive film 1072 includes a second covering portion 1072*a* and two second enclosing portions 1072*b* located at two sides of the second covering portion 1072*a*, and a second notch 1072*c* corresponding to the second covering portion 1072*a* is formed between the second enclosing portions 1072*b*.

The first conductive film 1071 and the second conductive film 1072 are opposite disposed, and the first conductive film 1071 is disposed within the second conductive film 1072. The first covering portion 1071*a* is closer to second notch 1072*c* than the both first enclosing portions 1071*b*. The both first enclosing portions 1071*b* is closer to second covering portion 1072*a* than the first covering portion 1071*a*. The first enclosing portions 1071*b* partially overlap the second enclosing portions 1072*b* respectively. Therefore, the first conductive film 1071 and the second conductive film 1072 enclose the both signal wires 101, whereby the signals transmitted in both signal wires 101 of each cable 10 interfere the signals transmitted in the signal wires 101 of the adjacent cable 10, and thus the flat cable assembly 1 has an excellent effect on anti-EMI and promoted signal transmitting performance. The first enclosing portions 1071*b* are circular arced, and the center of the first enclosing portions 1071*b* overlaps the center of the adjacent signal wire 101. The first enclosing portions 1071*b* has a central angle 01 ranging from 10° to 180°; the second enclosing portions 1072*b* are circular arced, and the center of the second enclosing portions 1072*b* overlap the center of the adjacent signal wire 101. The second enclosing portion 1072*b* has a central angle ranging from 10° to 180°.

The electric conductive layer 107 further includes an insulating spacing film 1073 disposed between the first conductive film 1071 and the second conductive film 1072. In other word, the first conductive film 1071 disposed on a surface of the insulating spacing film 1073 in the vicinity of the signal wire 101, and the second conductive film 1072 is disposed on a surface of the insulating spacing film 1073 in the vicinity of the grounding wire 10, whereby the or first conductive film 1071 and the second conductive film 1072 are secured and spaced by the insulating spacing film 1073. The first conductive film 1071 and the second conductive film 1072 are made by metal, which is selected from a group consisting of aluminum, copper, lead and tin.

The signal wire 101 of the present embodiment includes a signal conductor 1011 and an insulating layer 1012 enclosing a peripheral surface of the signal conductor 1011, and two axial ends of the signal conductor 1011 may reveal from the insulating layer 1012. The signal conductor 1011 is a slender cylinder or weaved by a plurality of conductive wires. The signal conductor 1011 is made of metal, which is selected from a group consisting of copper, aluminum, tin, nickel, silver and gold. That is the signal conductor 1011 can be made of an alloy made by the aforementioned metal elements or formed by a metal substrate coated with the aforementioned metal elements, such as tin-copper coating or silver-copper coating. The insulating layer 1012 is a non-conductive tape made of polyester material. The tape is spirally wound on the peripheral surface of the signal conductor 1011, and the tape is fixed on the signal conductor 1011 with glue; or the insulating layer 1012 is formed on the peripheral surface of the signal conductor 1011 by coating with polyester material. The polyester material is selected from a group consisting of polyvinyl chloride, polyethylene, polypropylene, and copolymer of fluorinated ethylene and propylene. The grounding wire 102 has a grounding conductor, which is a slender cylinder or weaved by a plurality of conductive wires. The grounding conductor is made of metal, which is selected from a group consisting of copper, aluminum, tin, nickel, silver and gold.

The cable 10 of the present embodiment includes two signal wires 101 for form a differential signal pair. That also means that the cable 10 of the present embodiment transmits differential signals with the differential signal pair, whereby the interfere energy of the adjacent signal wires 101 cancel each other during the signal transmission to promote the ability in anti-EMI and the signal transmission performance.

Figure 6:
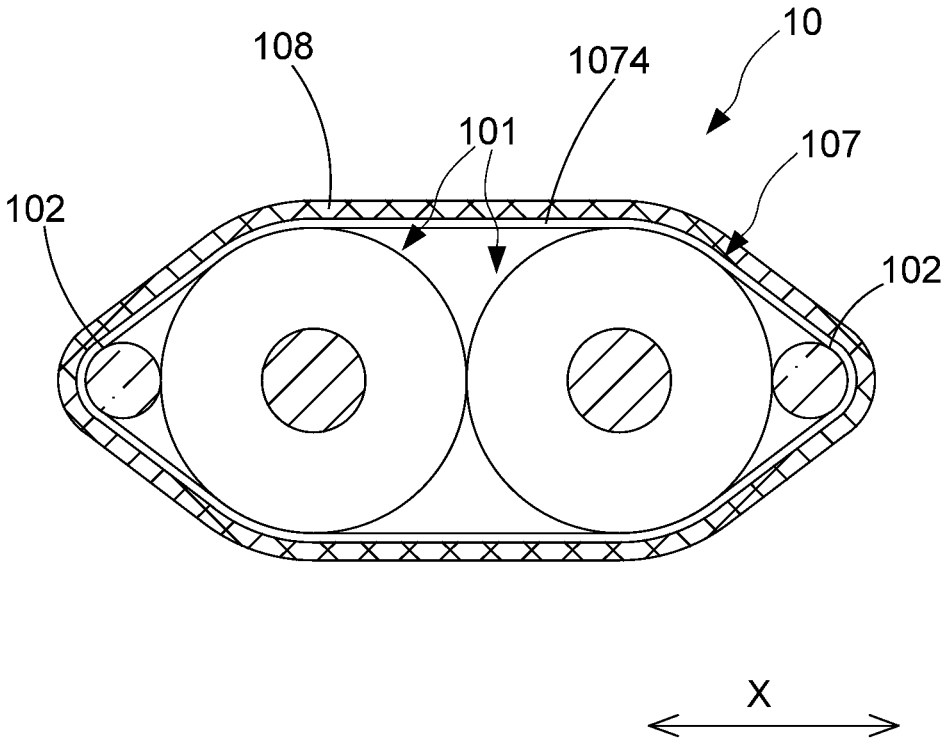
FIG. 6 is a schematic view of the fourth embodiment of a flat cable assembly of the present application.

Referring to FIG. 6, the fourth embodiment of the cable is illustrated. The cable 10 of the present embodiment differs from the first embodiment in that the both grounding wires 102 are disposed within the electrically conductive layer 107, and the both grounding wires 102 are disposed on two sides of the signal wires 101, and the center of the both signal wire 101 and the center of the both grounding wire 102 are arranged in a row along the horizontal direction X. The electrically conductive layer 107 encloses the both signal wires 101 and the both grounding wires 102. The both grounding wires 102 contact the electrically conductive layer 107. The electrically conductive layer 107 of the present embodiment includes an electrically conductive layer 1074. The electrically conductive layer 1074 is made of metal, which is selected from a group consisting of aluminum, copper, lead and tin. The insulating enclosing layer 108 directly encloses the electrically conductive layer 107. The cable of the first embodiment, the second embodiment and the third embodiment can be replaced by the cable 10 of the present embodiment.

Figure 7:
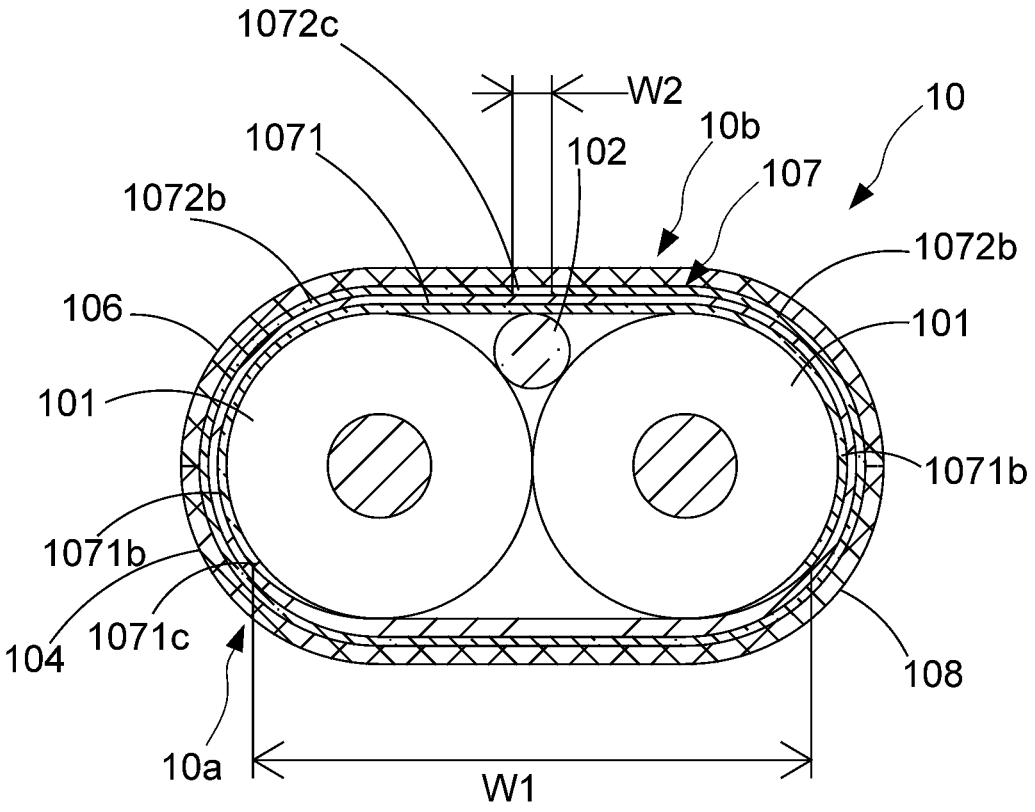
FIG. 7 is a schematic view of the fifth embodiment of a flat cable assembly of the present application.

Referring to FIG. 7, the fifth embodiment of the cable is illustrated. The cable 10 of the present embodiment differs from the first embodiments in that only one grounding wire 102 is presented, and the grounding wire 102 is located within the electrically conductive layer 107. The grounding wire 102 is disposed between the both signal wires 101 and contacts the both signal wires 101. The electrically conductive layer 107 encloses two signal wires 101 and the grounding wire 102. The grounding wire 102 contacts the first conductive film 1071 of the electrically conductive layer 107. The first conductive film 1071 has a structure the same as the first conductive film of the electrically conductive layer of the first embodiment.

The second conductive film 1072 of the electrically conductive layer 107 of the present embodiment has a structure different from the second conductive film of the first embodiment. As for the second conductive film 1072 of the present embodiment, the both second enclosing portions 1072*b* have two very closed ends located in positions away from the second enclosing portion 1072*b*, that is the width W2 of the second notch 1072*c* is far less than the width W1 of the first notch 1071*c*, whereby the overlapping area of the first conductive film 1071 and the second conductive film 1072 is increased to ensure that the first conductive film 1071 and the second conductive film 1072 completely enclose the both signal wires 101, and thus the flat cable assembly 1 has an excellent effect on anti-EMI and a promoted performance in signal transmission. The insulating enclosing layer 108 directly encloses the electrically conductive layer 107. The second surface 104 of the connecting portion 10*a* and the fourth surface 106 of the fixing portion 10*b* are circular arced. The second surface 104 does not coincide with the shortest line extending through two lateral sides of the second surface 104. The cable of the first embodiment, the second embodiment and the third embodiment can be replaced by the cable 10 of the present embodiment.

In summary, this application provides a flat cable assembly. The insulating film is disposed on a single side of the cables, whereby the cables are exposed from the insulating film. The flat cable assembly is easily manufactured and the amount of the cables therein can be varied according to real practice condition. In addition, the grounding wire is integrated to each cable, whereby the flat cable assembly has an excellent anti-EMI effect and an excellent performance in signal transmission. In addition, the insulating film of the present application has a plurality of connection concave portions, and the insulating film covers the first surface and the both second surfaces of each connection portion, whereby the contact area between the insulating film and the multiple cables is effectively increased, and the stability of the connection between the insulating film and the cables is promoted. In addition, both sides of the insulating film extend beyond the central lines of the cables to connect the fixing portion of the corresponding cables to ensure the insulating film being secured on the cables without falling off. In another condition, the both sides of the insulating film extend along the direction away from the cables and fixed to a device when the flat cable assembly is connected to the device, and the flat cable assembly is thus fixed to the device.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

It is to be understood that the term "comprises", "comprising", or any other variants thereof, is intended to encompass a non-exclusive inclusion, such that a process, method, article, or device of a series of elements not only includes those elements but also includes other elements that are not explicitly listed, or elements that are inherent to such a process, method, article, or device. An element defined by the phrase "comprising a . . . " does not exclude the presence of the same element in the process, method, article, or device that comprises the element.

Although the present invention has been explained in relation to its preferred embodiment, it does not intend to limit the present invention. It will be apparent to those skilled in the art having regard to this present invention that other modifications of the exemplary embodiments beyond those embodiments specifically described here may be made without departing from the spirit of the invention. Accordingly, such modifications are considered within the scope of the invention as limited solely by the appended claims.

What is claimed is:

1. A flat cable assembly, comprising:

a plurality of cables arranged in a row and having a central line, wherein each of the cables has a connecting portion, a signal wire and a grounding wire, the connecting portion is located on one side of the central line; and an insulating film disposed on the connecting portion of any one of the cables, and the insulating film includes an extending fixing portion, the extending fixing portion extend from the connecting portion from the plurality of cables, wherein the insulating film is disposed on one side of the central line, and the cables are exposed from the insulating film;

a release film disposed on the extending fixing portion;

wherein each of the cables comprises two signal wires, two grounding wires, an electrically conductive layer and an insulating enclosing layer, the both signal wires abut each other, the electrically conductive layer encloses the both signal wires, the grounding wires are disposed on two outer sides of the electrically conductive layer and contacts the electrically conductive layer, the insulating enclosing layer encloses the grounding wires and the electrically conductive layer enclosing the signal wires, the signal wires have centers located at the central line, and the grounding wires have centers located at the central line.

2. The flat cable assembly according to claim 1, wherein the connecting portion has a first surface and two second surfaces, the insulating film comprises a plurality of connecting concave portions disposed on the second surfaces of the adjacent connecting portions respectively.

3. The flat cable assembly according to claim 2, wherein a minimum distance between any one of the connecting concave portions and the central line is smaller or equal to half a minimum distance between the first surface and the central line.

4. The flat cable assembly according to claim 2, wherein any one of the connecting concave portions has a cross section of triangle, trapezoid or rectangle.

5. The flat cable assembly according to claim 2, wherein each of the connecting concave portions further has a cutting surface with two sides connecting to the two adjacent connecting portions and disposed between the two adjacent connecting portions.

6. The flat cable assembly according to claim 1, wherein each of the cables further comprises a fixing portion symmetrical with the connecting portion, the fixing portion is disposed on the other side of the central line, the insulating film further comprises extending fixing portions on both sides, and the extending fixing portions are disposed on the fixing portions of the outermost cables, and both sides of the insulating film is located on the other side of the central line.

7. The flat cable assembly according to claim 6, wherein the insulating film has bending portions on both sides, and the bending portions are located between the connecting portion and the fixing portion.

8. The flat cable assembly according to claim 1, wherein the insulating film further comprises extending fixing portions on both sides, and the extending fixing portions extend from the outermost cables along a direction away from the cables.

9. The flat cable assembly according to claim 1, wherein the electric conductive layer comprises a first conductive film and a second conductive film, the first conductive film is located at an inner side of the second conductive film, the first conductive film partially overlaps the second conductive film, the first conductive film and the second conductive film surround the signal wires, and the grounding wires contact the second conductive film.

10. A flat cable assembly, comprising:

a plurality of cables arranged in a row and having a central line, wherein each of the cables has a connecting portion, a signal wire and a grounding wire, the connecting portion is located on one side of the central line; and an insulating film disposed on the connecting portion of any one of the cables, and the insulating film includes an extending fixing portion, the extending fixing portion from the connecting portion from the plurality of cables, wherein the insulating film is disposed on one side of the central line, and the cables are exposed from the insulating film;

a release film disposed on the extending fixing portion;

wherein each of the cables comprises two signal wires, an and an insulating enclosing layer, the signal wires are adjacent, the grounding wires are disposed between the signal wires, the electric conductive layer encloses the signal wires and the grounding wires, the grounding wires contact the electric conductive layer, and the insulating enclosing layer encloses the electric conductive layer.

11. The flat cable assembly according to claim 10, wherein the electric conductive layer comprises a first conductive film and a second conductive film, the first conductive film is located at an inner side of the second conductive film, the first conductive film partially overlaps the second conductive film, the first conductive film and the second conductive film surround the signal wires, and the grounding wires contact the first conductive film.

12. The flat cable assembly according to claim 11, wherein the first conductive film comprises a first covering portion and two first enclosing portions located at two sides of the first covering portion, a first notch corresponding to the first covering portion is formed between the first enclosing portions; the second conductive film comprises a second covering portion and two second enclosing portions located at two sides of the second covering portions, a second notch corresponding to the second covering portion is formed between the second enclosing portions, the second covering portion covers the first notch, and the both first enclosing portions partially overlap the both second enclosing portions respectively.

13. The flat cable assembly according to claim 12, wherein the first enclosing portions are circular arced, any one of the first enclosing portions has a central angle ranging from 10° to 180°; the second enclosing portions are circular arced, any one of the second enclosing portions has a central angle ranging from 10° to 180°.

14. The flat cable assembly according to claim 12, wherein the electric conductive layer further comprises an insulating spacing film disposed between the first conductive film and the second conductive film.

15. The flat cable assembly according to claim 9, wherein the first conductive film comprises a first covering portion and two first enclosing portions located at two sides of the first covering portion, a first notch corresponding to the first covering portion is formed between the first enclosing portions; the second conductive film comprises a second covering portion and two second enclosing portions located at two sides of the second covering portions, a second notch corresponding to the second covering portion is formed between the second enclosing portions, the second covering portion covers the first notch, and the both first enclosing portions partially overlap the both second enclosing portions respectively.

16. The flat cable assembly according to claim 15, wherein the first enclosing portions are circular arced, any one of the first enclosing portions has a central angle ranging from 10° to 180°; the second enclosing portions are circular arced, any one of the second enclosing portions has a central angle ranging from 10° to 180°.

17. The flat cable assembly according to claim 15, wherein the electric conductive layer further comprises an insulating spacing film disposed between the first conductive film and the second conductive film.

* * * * *